United States Patent [19]

Lyons, III

[11] 4,068,202

[45] Jan. 10, 1978

[54] RECIPROCABLE MAGNET SWITCH

[75] Inventor: Michael J. Lyons, III, Loudonville, N.Y.

[73] Assignee: Walter F. Wessendorf, Jr., Guilderland, N.Y.

[21] Appl. No.: 693,713

[22] Filed: June 7, 1976

[51] Int. Cl.[2] ..... H01H 9/00

[52] U.S. Cl. ..... 335/207; 200/16 D; 200/260; 335/205; 335/306

[58] Field of Search ..... 200/16, 16 B, 16 D, 200/159 R, 260, 261, DIG. 27, 318; 335/193, 205, 206, 207, 306

[56] References Cited

U.S. PATENT DOCUMENTS

| | | | |
|---|---|---|---|
| 2,785,240 | 3/1957 | Carling | 200/16 D |
| 3,025,372 | 3/1962 | Benson | 335/207 |
| 3,114,809 | 12/1963 | Benson | 335/207 |
| 3,209,097 | 9/1965 | Shlesinger, Jr. | 335/207 |
| 3,529,269 | 9/1970 | Gardiner | 335/207 |
| 3,681,723 | 8/1972 | Goll | 335/207 |
| 3,729,600 | 4/1973 | Solomon et al. | 200/16 D |
| 3,743,980 | 7/1973 | Steiner | 335/205 |
| 3,786,206 | 1/1974 | Kurimsky | 200/16 D |
| 3,846,596 | 11/1974 | Wolf | 200/16 D |

*Primary Examiner*—Volodymyr Y. Mayewsky
*Attorney, Agent, or Firm*—Walter F. Wessendorf, Jr.

[57] ABSTRACT

Discloses a switch for use with a circuit board for simultaneously closing one or more circuits. A switch cover mounts therein a reciprocable member whose permanent strip magnet carries one or more contact elements for circuit completion. The circuit board carries another permanent strip magnet. The strip magnets have consecutive, alternating polarities such that, in the closed position of the switch, the strip magnets have opposite attracting polarities, and such that, in the open position of the switch, the strip magnets have the same and repelling polarities.

9 Claims, 5 Drawing Figures

FIG. 4.
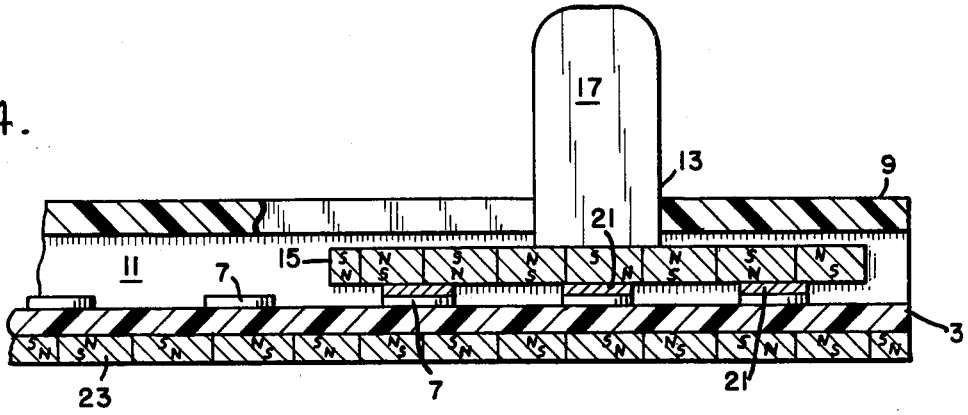
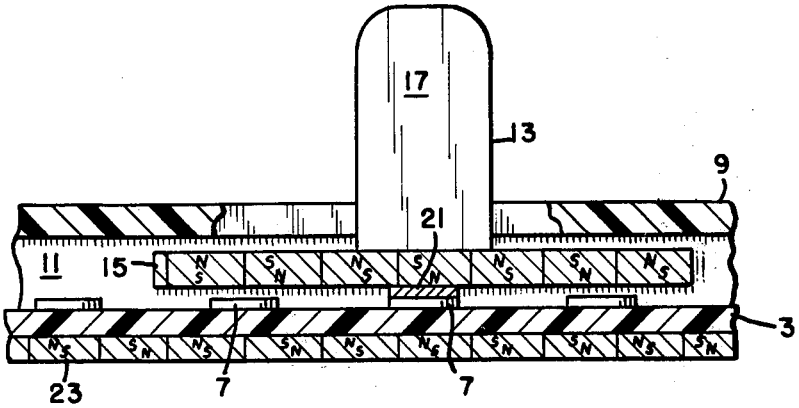
FIG. 5.

RECIPROCABLE MAGNET SWITCH

This invention relates to a switch for use with a circuit board for simultaneously closing one or more circuits.

The present technology is to employ mechanical-type switches that are spring-loaded to close or open simultaneously one or more circuits in a circuit board. Such mechanical-type switches are added to or attached to the existing circuit boards.

In such prior art, when such switch fails, the switch part or element needing replacement or repair often is not replaced or repaired because the labor costs required to replace or repair such switch part or element would exceed the costs to entirely replace the printed circuit board along with the switch or switches.

Similarly, in the prior art the switch contact elements do not close square with their circuit-terminal elements, but instead such elements wear from rubbing contact during circuit closing and opening. This phenomenon results in or contributes to switch failure because such elements wear out, and with high-voltage arcing and carbon deposit result in switch failure.

Spring-loaded switches also have a resonant frequency which, if attained such as by vibration, could cause switch opening.

Accordingly, the objects of this invention are to contribute to the solution of the discussed problems of the art and to inclusively contribute to the progress in and improvement of this field of art by providing a switch of this invention that is both compact and can be used with existing circuit boards or easily incorporated in the initial design of a printed circuit board; by providing a switch of this invention for use with a circuit board and which results in a less expensive circuit board because of the elimination of the additional costs and expenses involved in the additional assembly needed to add or attach conventional switches to such circuit boards; by providing a switch of this invention, for use with a circuit board, that is more reliable than a conventional switch for the reason that there are no parts to fail, such as springs from metal fatigue; and by providing a switch of this invention whose contact elements close square with the circuit-terminal elements of the circuit board, with such contact elements remaining in parallel relationship during switch closing and opening, to prevent switch failure arising from wear of such contact and circuit-terminal elements, arcing and carbon deposit.

These objects and other objects of the invention should be discerned and appreciated from the detailed specification taken in conjunction with the drawings, wherein like reference numerals refer to similar parts throughout the several views, in which:

FIG. 4 is a sectional view taken in the direction of the arrows 4 — 4 in FIG. 2; and FIG. 5 is a sectional view taken in the direction of the arrows 5 — 5 in FIG. 2 but shows only a single switch contact element.

Figure 1:
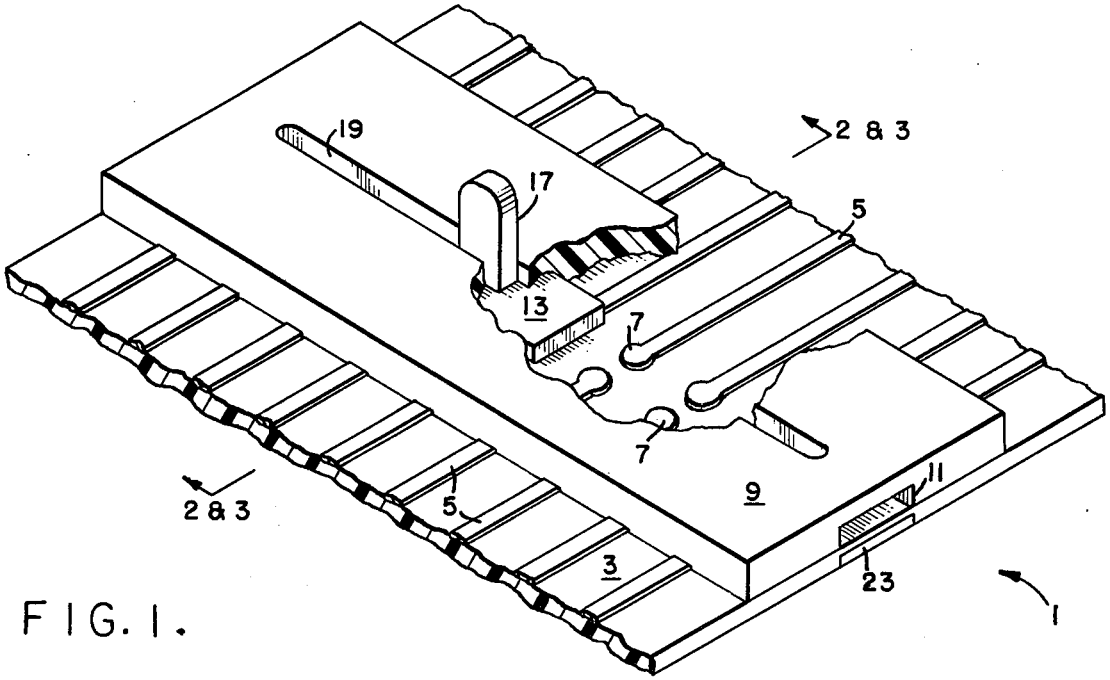
FIG. 1 is a perspective view of the invention, partly broken away and in section.

In FIG. 1 of the drawings, reference numeral 1 generally refers to the invention.

Depicted is part of an insulating board 3 having conductive strips 5 disposed thereon in equally spaced-apart and parallel relationship, together constituting part of a printed circuit board. Each of the conductive strips 5 has a circuit-terminal element 7.

Suitably fixed to insulating board 3, as shown, is the switch cover 9 of suitable non-conductive material. Relative to its longitudinal axis, switch cover 9 has a bottom slot 11 formed therethrough reciprocably and freely receiving a substantially complemental switch member 13.

Switch member 13, elongated and of rectangular configuration, has a permanent and non-conductive strip magnet 15. Suitably fixed to and upstanding from strip magnet 15 is a manipulative member 17, as shown, which is freely received for constrained reciprocable movement within a complemental and elongated, apertured opening 19 formed through switch cover 9.

Suitably fixed to and depending from strip magnet 15 are contact elements 21. The number of contact elements 21 carried on strip magnet 15, as well as the length of strip magnet 15, will depend upon the number of circuits desired to be closed simultaneously by engagement of the contact elements 21 with the circuit-terminal elements 7. The contact elements 21 are in equally spaced-apart and parallel relationship corresponding to the described spatial disposition and relationship of the conductive strips 5 and their circuit-terminal elements 7.

Suitably fixed to and imbedded within the bottom of insulating board 3, as shown, is a permanent and non-conductive strip magnet 23 of consecutive, alternating polarities. Strip magnet 15 is similarly of consecutive, alternating polarities.

Figure 2:
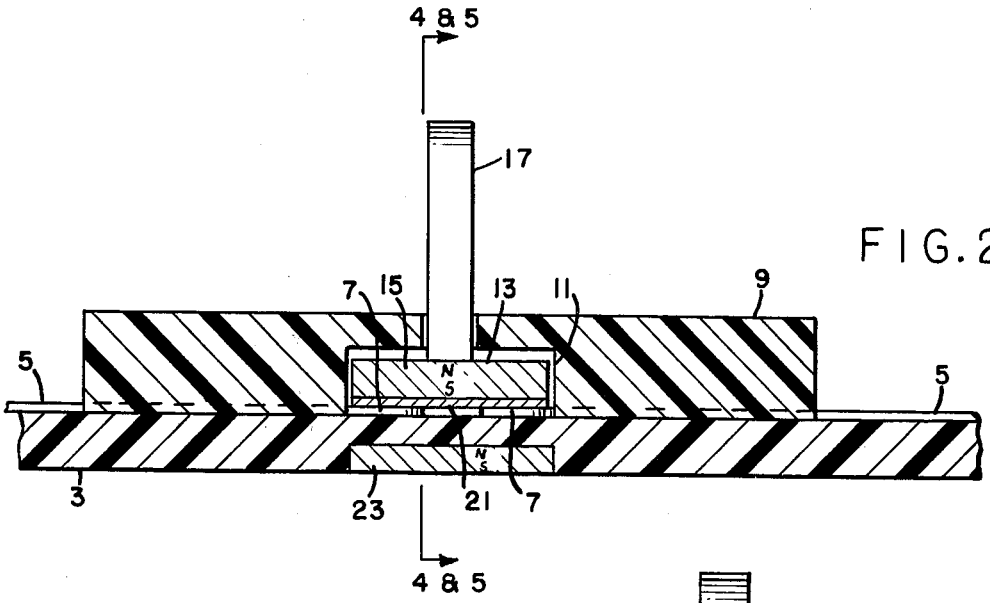
FIG. 2 is a sectional view taken in the direction of the arrows 2 — 2 in FIG. 1.

FIGS. 2 and 4 show the switch member 13 in its closed position. Switch member 13 has three contact elements 21 such that, when switch member 13 is in its closed position shown in FIGS. 2 and 4, the three contact elements 21 operatively engage three sets of circuit-terminal elements 7 of their respective conductive strips 5 to close three separate circuits thereby. Since, in any closed position of switch member 13 the strip magnets 15 and 23 have opposite attracting polarities, switch member 13 is maintained in such closed position.

Since the switch member 13 shown in FIG. 5 has only one contact element 21, it should be discerned and appreciated that such switch member 13 can close thereby only one separate circuit at a time upon appropriate reciprocable movement of switch member 13.

Figure 3:
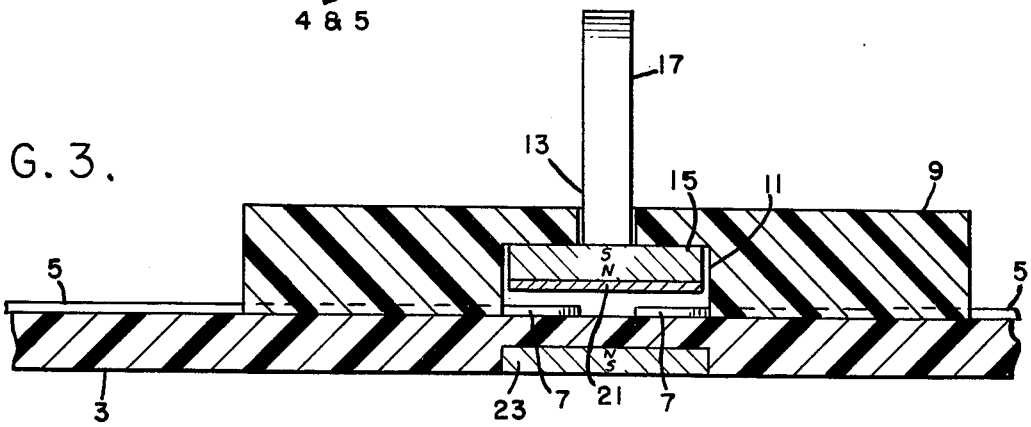
FIG. 3 is a sectional view taken in the direction of the arrows 3 — 3 in FIG. 1 and shows the open position of the switch effectuated by slight initial movement of the switch's manipulative member.

FIG. 3 shows switch member 13 in its open position effectuated by slight initial pushing movement of manipulative member 17 and hence slight movement of switch member 13 from its closed position. Slight movement of the switch member 13 in either direction relative to the longitudinal axis of switch cover 9 first operatively results in the strip magnets 15 and 23 having the same and repelling polarities such that engaged contact of the contact elements 21 with their respective circuit-terminal elements is broken, and secondly and immediately followed by the strip magnets 15 and 23 having opposite attracting polarities sufficient to constrain movement of switch member 13 into a new closed switch position immediately adjacent to and in the same direction in which the manipulative member 17 was initially moved.

It is also within the concept of this invention to provide a switch off-position wherein switch member 13 is in one of its closed positions as described but with the contact elements 21 engaging circuit-terminal elements 7 whose respective conductive strips 5 have permanent continuity interruption.

It should be noted that the circuit-terminal elements 7 and contact elements 21 are always in parallel relationship whether the switch member 13 is in a closed or open position. Hence, because the contact elements 21 do close square with their circuit-terminal elements 7, there is no wear from rubbing contact of such elements during circuit closing and opening.

Having thusly described my invention, I claim:

1. A switch for use with a circuit board of dielectric material adapted for such use and wherein said circuit board has conductive strips having circuit-terminal elements; said switch comprising a switch cover and switch member, said switch cover being of dielectric material, said switch cover mounting said switch member for translatory movement therein in circuit closing or opening, said switch member having an electrically non-conductive strip magnet having consecutive, alternating polarities and at least one contact element, said circuit board carrying an electrically non-conductive strip magnet having consecutive, alternating polarities, said switch having respective closed and open positions of engagement of said contact and circuit-terminal elements for circuit closing and of disengagement of said contact and circuit-terminal elements for circuit opening, said contact and circuit-terminal elements remaining always in parallel relationship, said contact and circuit-terminal elements closing square in circuit closing, and said strip magnets being arranged and disposed respecting said respective switch closed and open positions such that said strip magnets have opposite attracting polarities for circuit closing and said strip magnets having the same and repelling polarities for circuit opening.

2. A switch in accordance with claim 1, wherein said switch cover has a complemental slot and wherein said complemental slot receives said switch member.

3. A switch in accordance with claim 1, wherein said switch cover has an apertured opening, wherein said switch member has an upstanding manipulative member and wherein said apertured opening receives said upstanding manipulative member for movement therein.

4. A switch in accordance with claim 1, wherein said contact and circuit-terminal elements are in equal, spaced-apart relationship.

5. A switch in accordance with claim 1, wherein said switch member is elongated and of rectangular configuration, wherein said switch cover has a complemental slot and wherein said complemental slot of said switch cover reciprocably and freely receives therein said switch member.

6. A switch in accordance with claim 1, wherein the bottom of said circuit board carries its said strip magnet fixed therewith and imbedded within and wherein said switch member magnet carries on its lower portion said contact element.

7. A switch in accordance with claim 1, wherein said contact and circuit-terminal elements are in equal, spaced-apart relationship, wherein said switch member is elongated and of rectangular configuration, wherein said switch cover has a complemental slot and wherein said complemental slot of said switch cover reciprocably and freely receives therein said switch member.

8. A switch in accordance with claim 1, wherein the bottom of said circuit board carries its said strip magnet fixed therewith and imbedded within, wherein said switch member magnet carries on its lower portion said contact element, and wherein said contact and circuit-terminal elements are in equal, spaced-apart relationship.

9. A switch in accordance with claim 1, wherein said switch member is elongated and of rectangular configuration, wherein said switch cover has a complemental slot, wherein said complemental slot of said switch cover reciprocably and freely receives therein said switch member, wherein the bottom of said circuit board carries its said strip magnet fixed therewith and imbedded within, wherein said switch member magnet carries on its lower portion said contact element, and wherein said contact and circuit-terminal elements are in equal, spaced-apart relationship.

* * * * *